United States Patent [19]

Lemelson

[11] 4,397,196

[45] Aug. 9, 1983

[54] ELECTRONIC TOOL AND METHOD

[76] Inventor: Jerome H. Lemelson, 85 Rector St., Metuchen, N.J. 08840

[21] Appl. No.: 302,198

[22] Filed: Sep. 14, 1981

Related U.S. Application Data

[63] Continuation-in-part of Ser. No. 70,873, Aug. 29, 1979, abandoned.

[51] Int. Cl.[3] ..... B25B 23/14

[52] U.S. Cl. ..... 73/862.23

[58] Field of Search ..... 73/862.21, 862.23, 862.22

[56] References Cited

U.S. PATENT DOCUMENTS

| | | | |
|---|---|---|---|
| 3,306,100 | 2/1967 | Wilhelm et al. | 73/581 X |
| 3,970,155 | 7/1976 | Otto | 73/862.26 |
| 3,995,477 | 12/1976 | Almond | 73/862.23 |
| 4,000,565 | 1/1977 | Overby et al. | 179/1 SA X |
| 4,125,016 | 11/1978 | Lehoczky | 73/862.23 |

*Primary Examiner*—James J. Gill

[57] ABSTRACT

A mechanical turning device is provided, such as a wrench or screwdriver, for turning and tightening a fastener in a workpiece. In one form, the turning device contains a transducer, such as a strain gauge, operable to sense torque applied by the device to a fastener and to generate or modulate electrical signals to provide signals which are indicative of the torque applied. Computing and display means are provided for displaying the value of the torque generated in character form. In a particular form of the invention, a normally open switch is supported by the turning device and is closed when torque or force is first applied to a fastener by the turning device to connect a source of electrical energy, such as a battery, with the torque sensing and indicating devices. In another form, a synthetic speech generating circuit is provided together with computing means for operating such circuit to indicate by means of speech signals applied to a microphone supported by the device and by means of speech sounds generated by such microphone, the torque applied to the fastener. In yet another form, one or more transducers are supported by the torque turning device, which are operable to scan the fastener turned thereby and provide electrical signals indicative of the internal structure of the fastener for inspecting same when such electrical signals are applied to a visual display.

9 Claims, 5 Drawing Figures

ELECTRONIC TOOL AND METHOD

RELATED APPLICATIONS

This is a continuation-in-part of application Ser. No. 70,873 filed Aug. 29, 1979, for Electronic Tool, now abandoned.

SUMMARY OF THE INVENTION

This invention relates to a tool, such as a hand tool employed to turn a bolt, nut or screw to tighten such fastener with respect to an assembly or work member wherein the torque applied for effecting such turning is sensed and indicated by an electronic indicating means to permit the person effecting the tightening operation to know when a particular torque has been reached and to act accordingly in predeterminately securing the fastener to the work. A number of means are provided to indicate to the operator of the hand tool when a predetermined condition has been reached including the use of a torque sensing transducer for generating electrical signals which are representative of the torque applied, the use of a turn sensing device for counting the number of turns of the tool and electrically indicating such variable by means of a digital display to provide the operator with a visual indication in the form of the number of turns and the fraction of a turn applied to the fastener.

In a particular form of the invention, both the torque and the number of turns are simultaneously displayed on separate displays which are preferably supported by the tool.

In the operation of a conventional manually held and turned wrench or a power operated wrench or screwdriver, it is frequently necessary to indicate to the operator when a particular number of turns or torque has been applied to a fastener such as a bolt, machine screw or nut turned on the shank of a screw or bolt. By providing an indication of torque to the operator, the operator will know whether or not to stop turning or apply a predetermined additional number of turns or fraction of a turn to the nut or bolt so as to properly tighten the assembly, minimize damage to the fastener and minimize the possibility ot the fastener assembly's becoming loose or disassembled in use. Conventional mechanical torque indicating means have been devised which are not always accurate and are subject to shock and temperature changes in the tool and environment. The instant invention provides an electronic means for indicating torque applied between the tool and a fastener in turning the fastener to tighten it against the work. Concurrently with the indication of torque, an indication may also be provided of the number of turns applied to the fastener so that the operator thereof will have two types of information presented for controlling the fastening operation.

Accordingly, it is a primary object of this invention to provide a new and improved turning tool for applying fasteners to work.

Another object is to provide an improved wrench for tightening nuts and bolts in work assemblies which wrench includes electronic means associated therewith for indicating torque.

Another object is to provide a new and improved torque indicating tool containing its own electronic torque sensing and display means and a miniature battery for power operating such sensing and display.

Another object is to provide a hand tool, such as a wrench or screwdriver, for tightening a fastener against a work assembly, which tool includes a plurality of indicating means for warning or indicating to the operator when a predetermined number of turns have been applied to a fastener and/or when a predetermined torque has been reached or approached to permit the operator to properly tighten the fastener against the work to attain maximum fastening efficiency.

With the above and such other objects in view as may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

Figure 1:
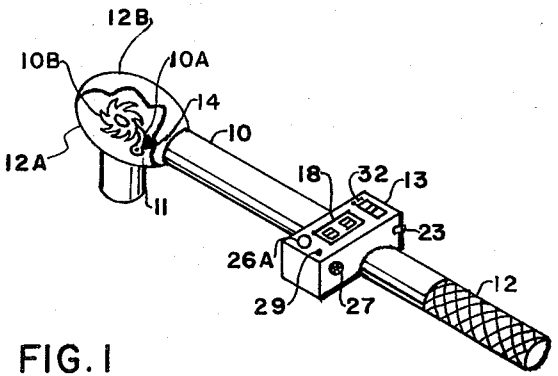
FIG. 1 is an isometric view with parts broken away for clarity of a tool in the form of a wrench for turning a fastener and containing attached thereto a housing for an electronic circuit and display driven by such circuit for indicating such variables as torque and number of turns of the wrench.

In FIG. 1 is shown a hand tool 10 in the form of a so called torque wrench defined by an elongated tubular housing 12 made of steel aluminum, or other suitable rigid material and containing a wrench head or socket 11 pivotally supported at the working end of the handle 12. The socket 11 is shaped with an open cavity therein which is configured to permit it to slideably engage the head of a bolt or a nut to be tightened against the shank of a bolt. The working end 12A of the wrench 10 is defined by a housing 12B, one wall of which supports a pin or shaft (not shown) of conventional design, to which pin or shaft the wrench socket 11 is secured for unidirectional rotation with respect to the head 12A. Secured to the shaft or pin of the wrench is a ratchet wheel 10B, the teeth of which are engaged by a pawl 10A. Such combination permits unidirectional movement of the wrench socket 11 when the wrench is pivoted on an axis defined by the nut or bolt against which the socket 11 is engaged.

An electronic strain gauge 14, which may be of the conventional resistance or piezoelectric crystal type, is mechanically attached to the pawl although it may also be secured to the ratchet wheel and is operable to provide an output signal which is proportional to the torque applied between the wrench socket 11 and the head end 12A of the handle 12.

Figure 2:
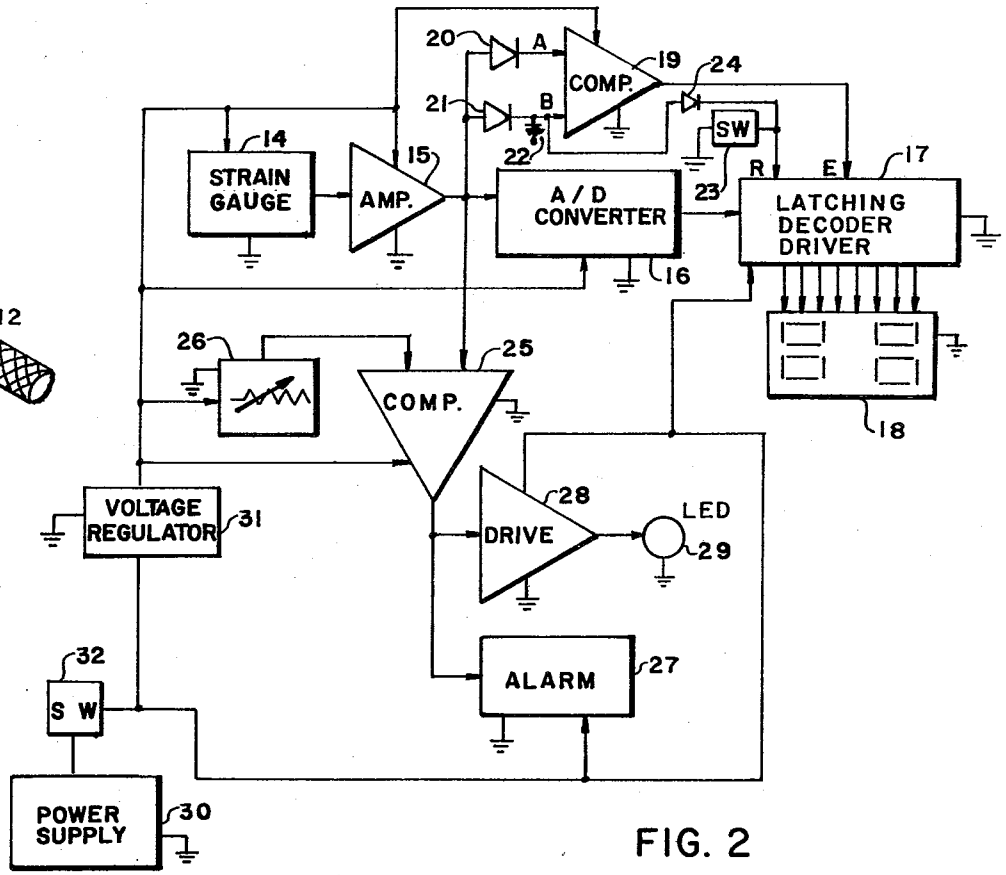
FIG. 2 is a schematic diagram illustrating electronic circuits and components for sensing and displaying characters indicative of torque applied by means of a tool of the type shown in FIG. 1.

In FIG. 2, the output signal generated by the strain gauge 14 is applied to the input of an amplifier 15, the output of which is an amplified analog signal which is passed to an analog-to-digital convertor 16, the output of which extends to the input of a latching decoder-driver 17 which presents the digital signals received from the convertor 16, in suitable format to an alphanumeric or numeric display 18 which may comprise a so called light emitting diode, liquid crystal display or other type of character indicating display adapted to respond to the signals presented thereto by the decoder-driver 17. Such display is created when an enable input E is energized by a signal received from a voltage comparator 19 which becomes activated whenever a voltage applied to an input A thereto, which is derived from the output of the amplifier 15 after passing through a diode 20, exceeds or is equivalent to a voltage applied to an input B thereto through a diode 21, which latter voltage is also received from the amplifier 15. Such enabling condition occurs whenever the signal generated by the strain gauge 14 is increasing, an indication that there is positive torque applied to the wrench mechanism when the handle 12 thereof is turned against resistance to such turning. Under such condition, the decoder-driver 17 is continuously energized or enabled and the display 18 is activated so as to display an indication of the torque applied to the fastener through the tool. A housing 13 secured to handle 13 supports the described elements which are connected to strain gauge 14 by means of wires extending therefrom through handle 12.

When the torque applied through the tool decreases or is released, such as when the wrench is removed from the bolt or nut being tightened, a capacitor 22, which is provided in the circuit extending to input B, temporarily holds its charge at the highest voltage level reached during the tightening operation so as to retain a suitable display of the highest torque reached. To permit capacitor 22 to temporarily hold its charge, electronic comparator 19 is preferably provided with a low drain input stage field effect transistor or the like. Since input A decreases immediately, causing the comparator 19 to terminate generation of an enable signal to the input of the decoder-driver 17 and terminates any further change in the display 18, as a result of the latching ability of the decoder-driver 17, the last reading of the display means 18 is maintained even after the enable signal is terminated and provides the operator of the wrench with a temporary indication of the highest torque reached even after the attainment of such torque and after the operator ceases to apply force to the wrench handle 12.

A single closure of a momentary contact stitch 23 serves to reset the decoder-driver 17 which causes the display 18 to return to zero as the capacitor 22 is discharged through an isolation diode 24 and then to ground, conditioning such components for the next torque indicating operation.

Additional features of the system illustrated in FIG. 2 include the use of an audible or visual alarm for indicating attainment of a preset or predetermined torque in a fastening operation. The output of amplifier 15 is connected to one input of a voltage comparator 25, which comparator has its other input extending from a source 26 of variable voltage which is controllable by manually turning a knob 26A, shown in FIG. 1 as rotationally supported on housing 13 which also contains the display and electronics described. Such manually operable knob 26A is calibrated to predeterminately set the voltage for the comparator 25 by hand and thereby predetermine the torque at which the alarm will be triggered or activated. When parity exists between the inputs to the comparator 25, an output signal therefrom is applied to trigger or energize an audible alarm 27 such as a buzzer, bell, oscillator and speaker and/or a visual alarm, such as a light emitting diode 29, by energizing a driver 28 therefor.

FIG. 2 illustrates a suitable power supply or battery 30 which may be supported within the housing 13 or handle 12 of the tool and which is connected to energize the described electronic components by means of a switch 32, which may be a normally closed manually openable bistable switch supported by housing 13 or a normally open, spring biased switch supported within the housing 12B and connected to be closed during the first degree of relative movement between the socket 11 and the working end of the wrench as a fastener is tightened thereby. A voltage regulator 31 is also provided in the output of power supply 30 and supplies a controlled voltage to all voltage sensitive components of the system, such as the strain gauge 14, the amplifier 15, the comparator 19, comparator 25, and the voltage variable circuit 26 which may comprise a variable resistor or capacitor.

Figure 3A:
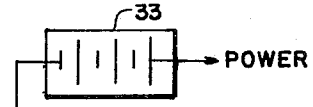
FIG. 3A is a schematic diagram of a first form of battery applicable to the system of FIG. 2.
Figure 3B:
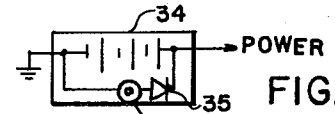
FIG. 3B is a schematic diagram of a rechargeable battery and protection diode means applicable to the system of FIG. 2.

In FIG. 3A a conventional battery 33 defines the power supply 30 and has its output connected through switch 32 to the circuits illustrated in FIG. 2. In FIG. 3B, a rechargeable battery 34 is provided with a protection diode 35 extending beyond a charge input socket 36.

Figure 3C:
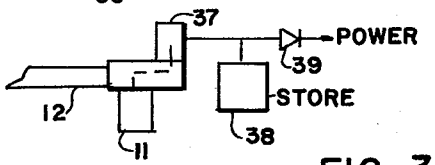
FIG. 3C is a schematic diagram illustrating an electro-mechanical generator of electricity applicable for powering the circuits of FIG. 2 to display torque without the need for a conventional battery.

In FIG. 3C, there is shown a small generator 37 which is mechanically connected between the wrench socket 11, preferably through a gear train (not shown), to generate a current whenever the wrench is used and the socket 11 is turned with respect to the remaining portion of the wrench assembly. The output of the generator 37 is connected to a suitable short term storage device 38 such as a capacitor, rechargeable battery or other means, the output of which is connected through a protection diode 39 to the switch 32. Such arrangement is provided for operation of the device when a liquid crystal diode display or the like is utilized so as to maintain the final or peak torque reading even in the absence of a supply of current and when the demand for electrical power is at a minimum.

It should be understood with respect to circuit diagrams, that suitable electrical energy is provided by the battery supported by the tool or may be provided by an external source connected to the tool circuits by a flexible cable for appropriately operating the various components and circuits as described in the specification.

Other forms of the invention are noted as follows:

I. Synthetic speech generating circuitry and a speaker may be employed which is supported by the housing 13 or a portion of the handle or tubular housing 12 and operatively connected to be activated to provide synthetic speech indicative of either or both torque applied by the wrench to a fastener and/or a speech indication that the torque applied is approaching or has exceeded a preset or desired torque. Such a system may supplement or replace the alarm 27 and may utilize electronic synthetic speech generating circuitry such as the Texas Instruments Corporations TMC 0280 integrated circuit with suitable support circuits, which circuit is operatively connected to receive the described digitized strain gage signals and compare same to code signals from a memory and electronic comparator or microprocessor, the output of which is employed to selectively energize the synthetic speech signal generating circuits which itself generates digital signals which are converted to analog speech signals by means of a digital-to-analog converter, which analog signals are applied to a small speaker which may replace the device 27 or supplement same. Such synthetic speech signal generator may be programmed to generate speech signals of the numbers 1–10 as well as other words necessary to indicate torque values by speech either when the wrench user has stopped turning the wrench, when a predetermined torque has been attained or is being approached or when a readout switch is closed by hand or other means. Other speech words may be provided in the synthetic speech generator such as "Torque exceeded, back off", "Approaching desired torque, . . . etc." and may be selectively generated in accordance with signals generated by the strain gage 14.

Such synthetic speech generating means may be located in a separate housing which is connectable by wire or cable to the circuit illustrated in FIG. 2.

II. In another form of the invention, the electronic wrench illustrated in FIG. 1 may include or be supplemented by an inspection means, such as an ultrasonic transducer or other form of transducing means and supporting circuitry for inspecting the fastener being tightened prior to, during and/or after tightening with such wrench for determining the integrity of the material of the fastener particularly in the vicinity of the head and shank, or head itself where failure frequently occurs due to stress induced cracks and flaws. Such transducer, which may be of the pulse-echo type of ultrasonic transmitter-receiver, may be supported within the wall of the socket 11, on the outside thereof, within the housing 12B or near the end of the handle 12 adjacent housing 12B, and may be operable when energized by suitable pulsed or alternating current supplied by a battery within handle 12 or housings 12B or 13 together with suitable electronic circuitry for amplifying such current and providing it at the proper high frequency to drive the transducer. Also supported within the housing supporting the battery and amplifying-converting circuits and/or within one or more of such adjacent housings are receiving and digitizing-display driving circuits for operating the display 18 and/or another display such as an "A" or "B" scan video display connected by wire or short wave coupled to receive the echo ultrasonic signals or the digitized results of scanning the fastener when the socket 11 is coupled thereto, for indicating either numerically or by video screen image, the condition of the fastener head and/or shank prior to, during and after the tightening operation.

If the socket 11 is of the replaceable or interchangeable type, each socket may contain a transducer or transducers which are automatically connected by pluggable connection to the analyzing electronic circuit when coupling to the socket connector is effected or a transducer supported by housing 12B is operable to be coupled to the wall of each socket when it is operatively engaged with the coupling device therefore.

III. In yet another form of the invention, a gear motor supported by the housing 12B may be connected to drive the shaft and coupling means connected to the socket 11 and such motor may be automatically controlled to terminate its driving action when a preset torque has been reached as determined by the manual setting of the variable resistor 26. In such arrangement, the other elements of the wrench shown in FIGS. 1 and 2 would be the same with means provided to indicate torque and permit operation of the wrench by manual turning.

What I claim is:

1. A wrench comprising in combination:

handle means, fastener retaining means connected to said handle means for retaining a fastener adapted to be turned thereby so as to permit said wrench to tighten said fastener, an electronic force detection means supported by said wrench for detecting torque created when said fastener holding means engages the fastener head and said handle means turns said fastener retaining means against the resistance to the turning of the fastener, battery means supported by said wrench, a normally open switch for connecting said battery means to said torque detecting means, means for closing said normally open switch when torque is applied through said fastener retaining means to the fastener to provide electrical energy from said battery means to power said electronic force detection means for detecting torque applied by said wrench to a fastener held by said fastener retaining means, and electrically operated display means supported by said wrench and connected to receive signals from said electronic force detection means for displaying the degree of torque applied by said handle means to said fastener retaining means when said normally open switch means is closed by torque applied through said fastener retaining means to said fastener and power from said battery means is applied to power said electronic force detection means.

2. A wrench in accordance with claim 1 including means for causing said display means to display peak torque as detected by said electronic force detection means during a measurement operation even after the applied torque is released.

3. A wrench in accordance with claim 2 wherein said torque sensing means is operable to generate a variable electrical signal in accordance with the torque applied between said wrench and said fastener and said display means is an electronic digital display operable to receive said electrical signals from said torque sensing means and become activated thereby and display a numerical indication of the torque signals received thereby.

4. A device in accordance with claim 3 wherein said handle means defines a housing containing said battery means and said display means.

5. A wrench in accordance with claim 2 wherein said display means is a liquid crystal display, said battery means is a rechargeable battery and additional means operable when torque is applied by said wrench to a fastener for generating electrical energy and applying such latter energy to recharge said battery means.

6. A device in accordance with claim 1 including alarm means supported by said handle means, means connected to said force detection means for activating said alarm means for indicating when a predetermined torque has been applied by said wrench to a fastener.

7. A device in accordance with claim 6 including manually adjustable means for adjusting said alarm means to become activated when different degrees of torque are applied to a fastener by said wrench.

8. A wrench in accordance with claim 1 including a synthetic speech signal generating means and electronic circuit means operable for processing and analyzing signals generated by said force detection means, said electronic circuit means being operable for selectively activating said synthetic speech signal generating means to cause said speech signal generating means to generate synthetic speech signals which are indicative of the torque detected by said detection means, and speaker means for receiving and transducing synthetic speech signals generated by said synthetic speech signal generating means to sounds of words indicative of torque applied by said wrench to a fastener.

9. A wrench in accordance with claim 1 including means for generating electrical energy when force is applied in tightening a fastener through said fastener retaining means and means for using said electrical energy to power said display means.

* * * * *